US005451860A

United States Patent [19]

Khayat

[11] Patent Number: 5,451,860

[45] Date of Patent: Sep. 19, 1995

[54] LOW CURRENT BANDGAP REFERENCE VOLTAGE CIRCUIT

[75] Inventor: Joseph M. Khayat, Bedford, N.H.

[73] Assignee: Unitrode Corporation, Billerica, Mass.

[21] Appl. No.: 65,570

[22] Filed: May 21, 1993

[51] Int. Cl.[6] ..... G05F 3/16

[52] U.S. Cl. ..... 323/314; 323/313

[58] Field of Search ..... 323/313, 314

[56] References Cited

U.S. PATENT DOCUMENTS

| | | | |
|---|---|---|---|
| Re. 34,772 | 11/1994 | Bernard et al. | 323/313 |
| 4,450,367 | 5/1984 | Whatley | 307/297 |
| 4,453,121 | 6/1984 | Noufer | 323/226 |
| 4,588,941 | 5/1986 | Kerth et al. | 323/314 |
| 4,792,750 | 12/1988 | Yan | 323/315 |
| 4,849,684 | 7/1989 | Sonntag et al. | 323/313 |
| 4,857,823 | 8/1989 | Bitting | 323/314 |
| 4,896,094 | 1/1990 | Greaves et al. | 323/314 |
| 4,935,690 | 6/1990 | Yan | 323/314 |
| 5,045,717 | 9/1991 | Moen, Jr. et al. | 307/296.3 |
| 5,049,806 | 9/1991 | Urakawa et al. | 323/314 |
| 5,061,862 | 10/1991 | Tamagawa | 307/296.1 |
| 5,126,653 | 6/1992 | Ganesan et al. | 323/313 |
| 5,144,223 | 9/1992 | Gillingham | 323/313 |
| 5,245,273 | 9/1993 | Greaves et al. | 323/313 |
| 5,307,007 | 4/1994 | Wu et al. | 323/313 |
| 5,349,286 | 9/1994 | Marshall et al. | 323/313 |

*Primary Examiner*—Jeffrey L. Sterrett
*Attorney, Agent, or Firm*—Weingarten, Schurgin, Gagnebin & Hayes

[57] ABSTRACT

A bandgap reference voltage circuit adapted for low current applications. A reference voltage is provided as a function of the difference between the $V_{be}$ voltages of a pair of bipolar transistors scaled by a ratio of the resistances of a pair of MOS transistors, to provide a predetermined reference voltage level. For a given reference voltage circuit size, use of the pair of MOS transistors achieves a low reference current in an integrated circuit, the size of which is far less than that implemented with conventional resistors. Alternatively, for a given reference current, the MOS transistor scaling provides a smaller reference circuit than is otherwise achievable.

17 Claims, 3 Drawing Sheets

LOW CURRENT BANDGAP REFERENCE VOLTAGE CIRCUIT

FIELD OF THE INVENTION

This invention relates generally to bandgap reference voltage circuits and more particularly, to a bandgap reference voltage circuit adapted for low reference current applications

BACKGROUND OF THE INVENTION

As is known, bandgap reference voltage circuits provide a substantially constant output reference voltage over a range of temperatures. That is, such circuits provide temperature compensation so that the output reference voltage does not vary with temperature. Generally, the output reference voltage is a function of the base to emitter voltage ($V_{be}$) of one bipolar transistor and the difference between the base to emitter voltages ($\Delta V_{be}$) of a pair of bipolar transistors having different current densities associated therewith. The value of the temperature independent reference voltage is adjusted by scaling the $\Delta V_{be}$ term. This arrangement provides the desired temperature compensation since the $V_{be}$ of a bipolar transistor has a negative temperature coefficient (i.e., the voltage $V_{be}$ decreases as temperature increases); whereas, the $\Delta V_{be}$ of a pair of bipolar transistors has a positive temperature coefficient associated therewith (i.e., the voltage $\Delta V_{be}$ increases as temperature increases). Thus, the temperature variations of the $V_{be}$ and the $\Delta V_{be}$ terms establishing the reference voltage ideally cancel, thereby providing a constant output reference voltage with temperature.

As is also known, CMOS integrated circuits have become widely used and thus, there has been a desire for a bandgap reference voltage circuit fabricated in accordance with CMOS techniques. The desirability of CMOS is, in part, due to the generally smaller die area required than with bipolar fabrication. Thus, to take advantage of the strengths of both bipolar and CMOS processing techniques, integrated circuits, including bandgap reference voltage circuits, have been fabricated using a combination of the two techniques to provide what is referred to as BiCMOS circuits.

One such prior art reference voltage circuit is shown in FIG. 1, with the output reference voltage $V_{REF}$ provided across the series combination of diode-connected bipolar transistor Q12 and resistor R2. More particularly, a current mirror arrangement establishes a reference current I at an input current path including MOS transistor M2, bipolar transistor Q4, and resistor R1. Such current I is "mirrored" in a first output current path including MOS transistor M6 and diode-connected bipolar transistor Q8 and in a second output current path including MOS transistor M10, bipolar transistor Q12, and resistor R2. The current densities of bipolar transistors Q4, Q8 are different, such as may be achieved by scaling the emitter area of transistor Q4 with respect to that of transistor QS. The $\Delta V_{be}$(Q8, Q4), (i.e., the difference between the base to emitter voltages of transistors Q8 and Q4), is equal to $V_T \ln X$, where $V_T$ is the thermal voltage (i.e., the product of Boltzmann's constant and temperature, divided by the electric charge) and X is the scale factor of the transistor areas. The reference current I and the reference voltage $V_{REF}$ can be expressed as follows:

$$I = \frac{V_{R1}}{R1} = \frac{\Delta V_{be}(Q8, Q4)}{R1} = \frac{V_T \ln X}{R1} \quad (1)$$

$$V_{REF} = V_{beQ12} + I \cdot R2 = V_{beQ12} + \frac{R2}{R1} V_T \ln X \quad (2)$$

Thus, the reference voltage $V_{REF}$ is a function of the $V_{be}$ of a bipolar transistor, here transistor Q12, and the $\Delta V_{be}$ of a pair of bipolar transistors, here transistors Q4 and Q8, with the $\Delta V_{be}$ scaled by the ratio of resistor R2 to R1 to provide a desired temperature independent reference voltage $V_{REF}$.

The required resistance for resistor R2 can be found from equation (2) to be:

$$R2 = \frac{V_{REF} - V_{beQ12}}{I} \quad (3)$$

From equation (3), it is apparent that the smaller the desired reference current I, the larger the required resistance of R2. Thus, the available die area for resistor R2 may limit the minimum reference current I.

SUMMARY OF THE INVENTION

In accordance with the invention, a bandgap reference voltage is provided as a function of the $\Delta V_{be}$ between a pair of bipolar transistors operated at different current densities and scaled by a ratio of resistances of a pair of MOS transistors. With this arrangement, a lower reference current is achievable for a given circuit size. Or, alternatively, a smaller reference circuit is provided for a given reference current level. More particularly, the required resistance value is inversely related to the value of the reference current and directly related to the required die area. Thus, in the present invention, the minimum reference current is not limited by available die area since resistors, heretofore used to scale the $\Delta V_{be}$ term of the bandgap reference voltage, are replaced by a pair of significantly smaller MOS transistors. Each of the pair of MOS transistors is operated in its linear region and the gate electrode parameters (i.e., length and width) are selected to provide the required predetermined reference voltage and current. Additionally, a MOS drain to source resistance in the linear region has a positive temperature coefficient similar to that of a diffused resistor. This positive temperature coefficient helps minimize reference current variations by tracking the positive temperature coefficient of the thermal voltage as observed in equation (1). By way of an example, for a reference current of approximately 200 nanoamps and a reference voltage of 1.2 volts, the required die area may be reduced by a factor of approximately 10:1 from that required by the circuit of FIG. 1.

More particularly, a bandgap reference voltage circuit includes first and second bipolar transistors having different current densities for providing a reference voltage as a function of the difference between the $V_{be}$ of such bipolar transistors. Also provided is a pair of MOS transistors, each one having a resistance associated therewith, with a first one of the MOS transistors coupled to the first bipolar transistor so that the $\Delta V_{be}$ between the bipolar transistors is scaled by the ratio of the resistances of the MOS transistors. The circuit includes a third bipolar transistor for providing the reference voltage as a function of the scaled $\Delta V_{be}$, which has a positive temperature coefficient, in combination with the $V_{be}$ of the third bipolar transistor, which has a negative temperature coefficient, so that the reference voltage is substantially temperature independent.

In accordance with a further aspect of the invention, a bandgap reference voltage circuit includes an input current path carrying a first current and a first output current path carrying a second, proportional current. Each such current path includes a bipolar transistor having different current densities. The input current path further includes a first MOS transistor having a gate characteristic that is a function of the ratio of the gate electrode length to the gate electrode width. Also provided is a second output current path, coupled to the input current path, at which a reference voltage is provided. The second output current path includes a second MOS transistor having a gate characteristic that is a function of the ratio of the gate electrode length to the gate electrode width. The reference voltage is a function of the ratio of the gate characteristic of the second MOS transistor to the gate characteristic of the first MOS transistor.

BRIEF DESCRIPTION OF THE DRAWINGS

The foregoing features of this invention, as well as the invention itself, may be more fully understood from the following detailed description of the drawings in which.

DESCRIPTION OF THE PREFERRED EMBODIMENT

Figure 2:
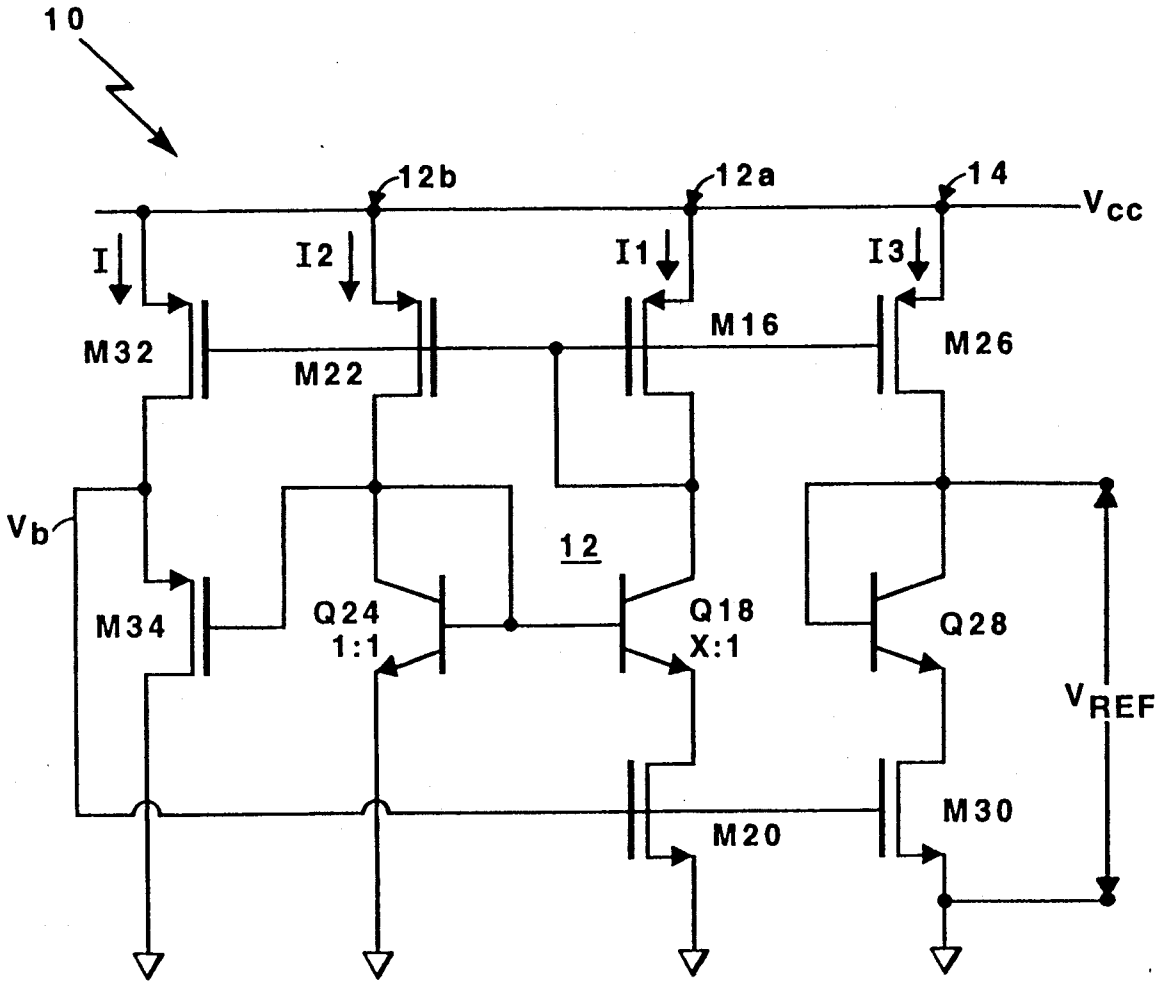
FIG. 2 is a schematic of a bandgap reference voltage circuit in accordance with the invention.

Referring now to FIG. 2, a bandgap reference voltage circuit 10 providing a substantially temperature independent reference voltage $V_{REF}$, includes a first bipolar transistor Q18 and a second bipolar transistor Q24 having different current densities J1, J2, respectively. The reference voltage $V_{REF}$ is a function of the difference between the $V_{be}$ of the first and second bipolar transistors Q18, Q24 (i.e., $\Delta V_{be}$ (Q24, Q18)). Also provided is a pair of MOS transistors M20, M30, each one having a resistance associated therewith. A first one of the MOS transistors M20 is coupled to the first one of the pair of bipolar transistors Q18 and the $\Delta V_{be}$(Q24, Q18) is scaled by the ratio of the resistance of the second MOS transistor M30 to the resistance of the first MOS transistor M20, as will be described. The reference voltage $V_{REF}$ is provided at a third bipolar transistor Q28, as shown. Thus, the reference voltage $V_{REF}$ is, more particularly, a function of the $V_{be}$ of the third bipolar transistor Q28 in combination with the between the first and second bipolar transistors Q18, Q24, with $\Delta V_{be}$ (Q24, Q18) scaled by the ratio of the resistance of MOS transistor M30 to that of MOS transistor M20.

Considering the circuit of FIG. 2 in greater detail, a current mirror 12 has an input current path 12*a* carrying a first current I1 and a first output current path 12*b* carrying a second current I2, proportional to current I1. Both the input and the first output current paths 12*a*, 12*b* include a bipolar transistor, here transistors Q18, Q24, respectively, having different current densities J1, J2 associated therewith. Additionally, the input current path 12*a* of the current mirror 12 includes the first MOS transistor M20 having a gate electrode with a length and a width, with a gate characteristic defined as a function of the ratio of the gate length to the gate width. A second output current path 14 is coupled to the input current path 12*a* and provides the reference voltage $V_{REF}$, as shown. The second output current path 14 includes the second MOS transistor M30 having a gate electrode with a length and a width, with a gate characteristic defined as a function of the ratio of the gate length to gate width. Here, the bandgap reference voltage $V_{REF}$ is a function of the ratio of the gate characteristic of the second MOS transistor M30 to the gate characteristic of the first MOS transistor M20, as will be described.

The value of the current I1 flowing through the input current path 12*a* is established by the drain to source resistance $R_{DS}$ of the first MOS transistor M20. By interconnecting the gate electrodes of transistors M16, M22, and M26, the current I1 is mirrored in the first output current path 12*b* and the second output current path 14. Here, transistors M16, M22, and M26 are of equal size so that currents I1, I2, and I3 are equal and will be referred to hereinafter as reference current I.

In certain applications, it may be desirable to have a relatively low reference current I. For example, a low current I may be desirable when the power supply providing voltage $V_{cc}$ is designed for low power operation or when the power supply voltage $V_{cc}$ is maintained by a bypass capacitor during a power down sequence in order to allow backup operations to be performed. In either case, a small current draw on the power supply voltage $V_{cc}$ is desirable. Here, the desired reference current I is equal to approximately 200 nanoamps and the desired reference voltage $V_{REF}$ is 1.2 volts.

As mentioned, the first and second bipolar transistors Q18, Q24 have different current densities J1, J2, here provided by scaling the emitter areas of such transistors. That is, bipolar transistor Q18 is scaled with respect to that of transistor Q24, with the ratio of the emitter areas of transistors Q18 to Q24 being X:1. Here, the scale factor X is selected to be two. While a larger scale factor X may be used, the larger the scale factor X, the larger the current I for the same $R_{DS}$, so that if the current I were to remain constant, a larger $R_{DS}$ or MOS area would be required. Thus, where a low current I and a small area is desired, a relatively small scale factor X is preferable. Current densities J1, J2 are equal to the ratio of the current through the respective transistor Q18, Q24 to the area of the respective emitter electrode. Thus, while here, the desired difference between current densities J1, J2 is provided by scaling the areas of transistors Q18, Q24 by a factor X (where X is other than one), the areas of series coupled transistors M16, M22 may alternatively be scaled, or a combination of scaling the areas of transistors Q18, Q24 and M16, M22 may be used to achieve unequal current densities J1, J2. Note that where unequal current densities J1, J2 are provided by scaling the areas of transistors M16, M22, currents I1 and I2 will not be equal, but rather will be proportional.

Regardless of the technique used to establish different current densities J1, J2 of transistors Q18, Q24, respectively, the difference between the base to emitter voltages of bipolar transistors Q18, Q24 and the reference current I are given by equations (4) and (5), respectively:

$$\Delta V_{be}(Q24, Q18) = V_T \ln X \quad (4)$$

-continued $$I = \frac{\Delta V_{be}(Q24, Q18)}{R_{DSM20}} = \frac{V_T \ln X}{R_{DSM20}} \quad (5)$$

where $V_T$ is the thermal voltage (i.e., the product of Boltzmann's constant and temperature, divided by the electric charge) and X is the area scale factor, as noted above. As mentioned, the second output current path 14 includes diode-connected bipolar transistor Q28, second MOS transistor M30, and MOS transistor M26 which is coupled to the input current path 12a to establish the reference current I through the second output current path 14. The reference voltage $V_{REF}$ provided across transistors Q28 and M30, as shown, and can be expressed as follows:

$$V_{REF} = V_{beQ28} + I \cdot R_{DSM30} = V_{beQ28} + \frac{R_{DSM30}}{R_{DSM20}} V_T \ln X \quad (6)$$

In operation, the negative temperature coefficient associated with the $V_{be}$ of transistor Q28 is offset, and ideally cancelled, by the positive temperature coefficient associated with the thermal voltage $V_T$. The value of the reference voltage $V_{REF}$ is set by appropriate scaling of the resistances of transistors M20 and M30. For example, in the case where the desired reference current I is 200 nanoamps, the desired reference voltage $V_{REF}$ is 1.2 volts, the scale factor X is selected as 2, and the $V_{be}$ of transistor Q28 is 0.6 volts, the required value of $R_{DS}$ of transistor M20 is determined by equation (5) above to be 87 Kohms. Solving for the $R_{DS}$ of transistor M30 in equation (6), the required resistance $R_{DS}$ of transistor M30 is found to be 3.0 Mohms.

In order to verify the reduction in size of bandgap circuit 10 as compared to conventional circuits utilizing diffused resistors to scale the $\Delta V_{be}$ term, it is noted that transistors M20, M30 are operated in the linear region, so that the current through each transistor M20, M30 is given by:

$$I_{DS} = \beta\left[(V_{GS} - V_t)V_{DS} - \frac{1}{2}V_{DS}^2\right] \quad (7)$$

where $V_{GS}$ is the gate to source voltage, $V_t$ is the threshold voltage, $V_{DS}$ is the drain to source voltage, and $\beta = KP \cdot (W/L)$ where KP is the product of the mobility and oxide capacitance per unit area. From equation (7) above, the drain to source resistance $R_{DS}$ of transistors M20, M30 can be determined. That is, conductance is found by taking the derivative of the current $I_{DS}$ with respect to $V_{DS}$ and the resistance is simply the reciprocal of the conductance. The resistance $R_{DS}$ Of each of MOS transistors M20, M30 is thus given by:

$$R_{DS} = \frac{1}{\beta[(V_{GS} - V_t) - V_{DS}]} \quad (8)$$

By assuming $(V_{GS} - V_t) >> V_{DS}$ and substituting $\beta = KP\ (W/L)$, the resistance given by equation (8) can be simplified to:

$$R_{DS} = \frac{L}{W \cdot KP(V_{GS} - V_t)} \quad (9)$$

so that:

-continued $$\frac{L}{W} = R_{DS} \cdot KP(V_{GS} - V_t) \quad (10)$$

Figure 1:
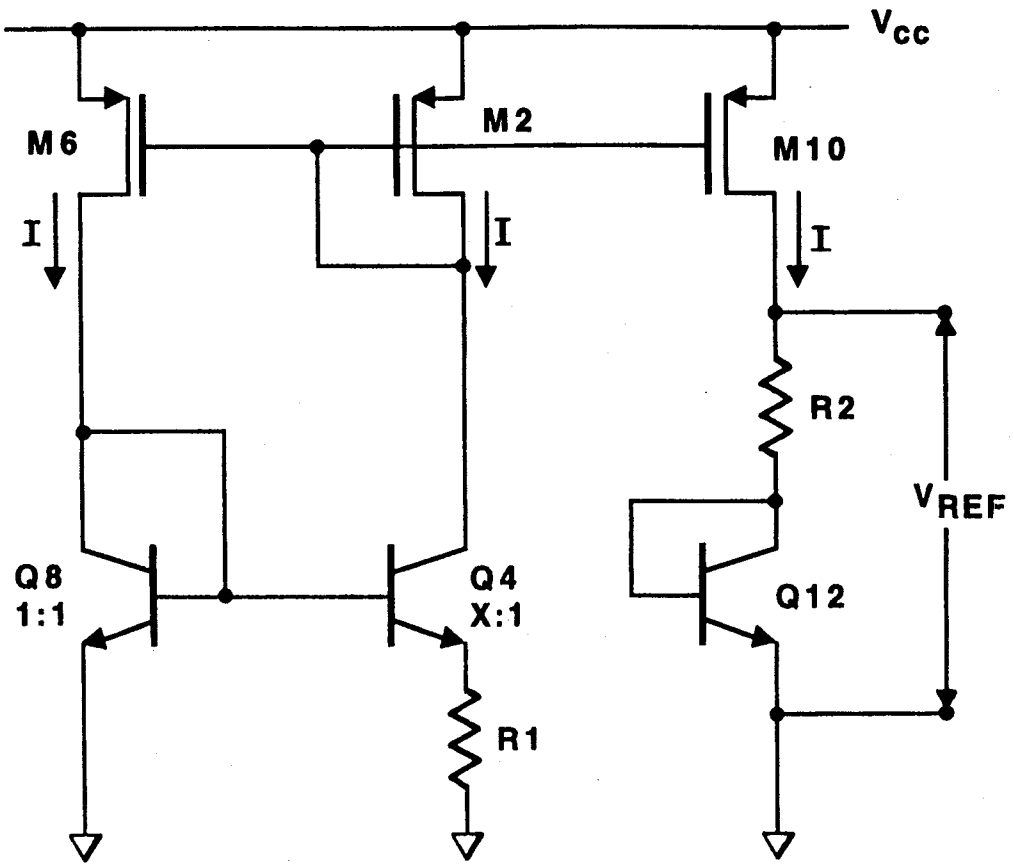
Fig. 1 PRIOR ART
FIG. 1 is a schematic of a prior art bandgap reference voltage circuit.

With this expression, the reduction in size of the bandgap reference voltage circuit 10 (FIG. 2), as compared to the conventional circuit of FIG. 1, can be demonstrated. Consider for example, the operation of transistors M20, M30 with a $V_{GS}$ of 4.0 volts, a threshold voltage $V_t$ of 0.7 volts, a KP of 45 $\mu A/V^2$, and an $R_{DS}$ Of 3.0 Mohms, as determined above. Using the above equation (10), L/W=446 squares. In fact, providing a resistance of 3.0 Mohms is likely to require even less die area since the value of KP is a function of the $V_{GS}$ which in turn, is a function of mobility. That is, KP as a function of $V_{GS}$ is equal to $KP/(1+\theta V_{GS})$, where $\theta$ is the mobility reduction factor and here, is 0.1. In so derating KP, the required die area is reduced to 319 squares. By way of comparison, it is noted that P or N diffused resistors provide between approximately 500 and 3000 ohms/square sheet rho and N+ or P+ diffused resistors provide only between 25 and 150 ohms/square sheet rho. Considering for example, a lightly doped diffused resistor with a 1000 ohms/square sheet rho, the 3.0 Mohm resistance would require 3000 squares. Thus, the area reduction by the present arrangement is, to a first approximation 9.4:1.

Consider next whether the desired positive temperature coefficient of a diffused resistor is provided by the $R_{DS}$ of the MOS transistor in the linear region. As given by equation (9), $R_{DS}$ is a function of the transconductance, KP, and the threshold voltage, $V_t$, each of which is temperature dependent. KP and $V_t$ vary with temperature as follows:

$$KP(T) = KP_o\left(\frac{T}{T_o}\right)^a \quad (11)$$

$$V_t(T) = V_{to} - b(T - T_o) \quad (12)$$

where the exponent a and the coefficient b are typically $-1.5$ and $1.5e^{-3}$ respectively.

Thus, as temperature T increases, both KP and $V_t$ decrease, whereas $V_{GS} - V_t$ increases. However, the amount by which KP decreases is substantially greater than the amount by which either $V_t$ decreases or $V_{GS} - V_t$ increases. Thus, the overall effect of temperature on Rns is to provide a positive temperature coefficient. That is, as temperature increases, so too does $R_{DS}$, thereby providing the desired positive temperature coefficient which tends to minimize the variations in the reference current.

The bias voltage $V_b$ at the gate electrodes of transistors M20, M30 is here, provided by transistors M32, M34 arranged as a third output current path of the current mirror 12. Thus, the gate to source voltage $V_{GS}$ is equal to the bias voltage $V_b$. That is, the gate electrode of transistor M32 is coupled to the gate electrode of transistor M16 so that current I4, here equal to current I, flows through transistors M32, M34. The bias voltage $V_b$ is provided at the interconnection between transistors M32, M34 and is equal to the $V_{be}$ of transistor Q24 plus the gate to source voltage of transistor M34. More particularly, M34 is sized so that the gate to source voltage thereof is large enough to provide a bias voltage $V_{be}$ suitable to maintain transistors M20 and M30 in the linear region. While various other arrangements may be used to bias transistors M20, M30, the present arrangement is desirable due to its simplicity.

Based on equation (8), the ratio of the resistance of transistor M30 to transistor M20 can be expressed as follows:

$$\frac{R_{DSM30}}{R_{DSM20}} = \frac{\frac{L_{M30}}{W_{M30}}}{\frac{L_{M20}}{W_{M20}}} \frac{[(V_b - V_t) - V_{DSM30}]}{[(V_b - V_t) - V_{DSM20}]} \quad (13)$$

Note here that KP of M30 cancels KP of M20 and $V_{GS}$ is replaced by $V_b$.

In view of the assumption that $(V_b - V_t) >> V_{DS}$, the ratio of the resistances of MOS transistors M20, M30 reduces to a ratio of the gate characteristics of such transistors, More particularly, defining gate characteristics of such transistors M20, M30 as being equal to the gate electrode length to the gate electrode width, the ratio of resistances of such transistors is simplified to the ratio of the gate characteristic of transistor M30 to the gate characteristic of transistor M20, Here, the gate widths of transistors M20, M30 are equal and the ratio of the resistances of such transistors is adjusted by changing the gate lengths, However, alternatively the gate widths of transistors M20, M30 can be adjusted alone, or in combination with adjusting the gate lengths, to achieve the desired resistance ratio.

It is noted that a certain amount of tolerance in the output reference voltage $V_{REF}$ occurs as a result of the simplification above, that $(V_{GS} - V_t) >> V_{DS}$. In considering the amount of such tolerance, it is noted that M20 and M30 have the same $V_{GS}$ since both transistors M20, M30 are biased by $V_b$. Transistors M20, M30 further have the same threshold voltage $V_t$ and transconductance KP values since such transistors M20, M30 are fabricated on the same substrate. Considering first transistor M20, it is observed that $V_{GS} - V_t$ is significantly larger than $V_t$ since the $V_{DS}$ of transistor M20 is equal to $V_T \ln X$, which, is approximately 0.0174 at room temperature and at X=2. Thus, it is apparent that $V_{GS} - V_t$ is in fact much larger than $V_{DS}$. However, this relationship does not apply to the same extent for transistor M30 since the $V_{DS}$ of transistor M30 is approximately 0.6 volts. It is noted that the tolerance thus introduced into the output reference voltage $V_{REF}$ can be minimized by adjusting (i.e., increasing) the $V_{GS}$. Here, the output reference voltage tolerance is approximately ±10%. It is noted that a small potential additional error in the output reference voltage $V_{REF}$ may result from mismatches in the KP, $V_t$, and L/W parameters of the pair of transistors M20, M30.

Figure 3:
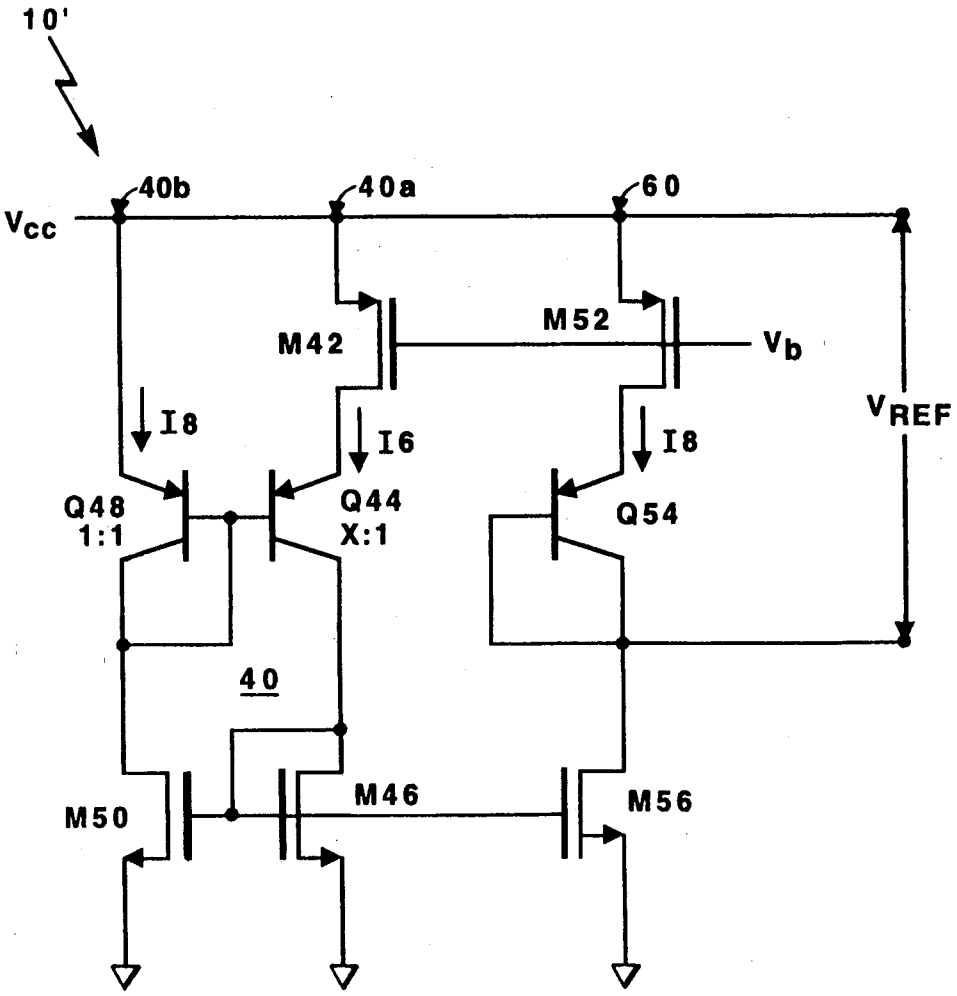
FIG. 3 is a schematic of an alternate embodiment of a bandgap reference voltage circuit in accordance with the invention.

Referring now to FIG. 3, an alternate embodiment 10' of the bandgap reference circuit 10 includes a current mirror 40 having an input current path 40*a* and a first output current path 40*b*. It is noted that bandgap reference circuit 10' is similar in operation to the reference circuit 10 of FIG. 2. Here however, the first and second MOS transistors M42, M52 are PMOS devices. In operation, a current I6 flows through the input current path 40*a* of current mirror 40 and a current I8, proportional to the current I6, flows through the first output current path 40*b*. Each of the input and first current paths 40*a*, 40*b* includes a bipolar transistor Q44, Q48, respectively, having different current densities. A second output current path 60 has a current I8 flowing therethrough, here a "mirrored" version of the current I6. The reference voltage $V_{REF}$ is established at the second output current path 60 and specifically across diode-connected transistor Q54 and transistor M52. More particularly, the reference voltage $V_{REF}$ is a function of the ratio of the gate characteristic of the second MOS transistor M52 to the gate characteristic of the first MOS transistor M42.

Having described the preferred embodiment of the invention, it will now become apparent to one of skill in the art that other embodiments incorporating their concepts maybe used. For example, the concepts described herein can be applied to other bandgap reference voltage circuit arrangements than the illustrative embodiments shown herein. It is felt therefore that these embodiments should not be limited to disclosed embodiments but rather should be limited only by the spirit and scope of the appended claims.

I claim:

1. A bandgap reference voltage circuit for providing a reference voltage comprising:

a first bipolar transistor and a second bipolar transistor, each of said first and second bipolar transistors having different current densities, wherein a reference voltage is provided as a function of the difference between the $V_{be}$ of said first and second bipolar transistors; and a pair of MOS transistors, each one operated in the linear region and having a resistance associated therewith, a first one of said pair of MOS transistors being coupled to said first one of said pair of bipolar transistors, wherein said reference voltage is a function of said difference between the $V_{be}$ of said first and second bipolar transistors scaled by the ratio of the resistance of a second one of the pair of MOS transistors to the resistance of said first one of said pair of MOS transistors.

2. The circuit recited in claim 1, further comprising a third bipolar transistor across which said reference voltage is provided, wherein said reference voltage is a function of the combination of the $V_{be}$ of said third bipolar transistor and said difference between the $V_{be}$ of said first and second bipolar transistors scaled by the ratio of the resistance of said second MOS transistor to the resistance of said first MOS transistor.

3. The circuit recited in claim 2, wherein each of said first and second MOS transistors has a gate electrode of equal width and wherein said reference voltage is a function of the ratio of the gate length of said second MOS transistor to the gate length of said first MOS transistor.

4. The circuit recited in claim 3, wherein said gate electrodes of said first and second MOS transistors are interconnected and wherein said circuit further comprises a third MOS transistor for biasing said first and second MOS transistors so that the gate to source voltage of said first and second MOS transistors is equal.

5. The circuit recited in claim 2, wherein said first and second MOS transistors are NMOS devices.

6. The circuit recited in claim 2, wherein said circuit is a BiCMOS circuit.

7. The circuit recited in claim 2, wherein said circuit is a CMOS circuit.

8. A bandgap reference voltage circuit comprising:

an input current path carrying a first current;

a first output current path carrying a second current, said second current being proportional to said first current, wherein said input current path includes a first bipolar transistor and said first output current path includes a second bipolar transistor, said first and second bipolar transistors having different current densities, and wherein said input current path includes a first MOS transistor having a gate electrode with a length and a width, wherein a gate characteristic of said first MOS transistor is equal to the ratio of the gate length to the gate width; and a second output current path carrying a third current, said third current being proportional to said first current, said second output current path including a third bipolar transistor providing a reference voltage, wherein said second output current path includes a second MOS transistor having a gate electrode with a length and a width, wherein a gate characteristic of said second MOS transistor is equal to the ratio of the gate length to the gate width, and wherein the reference voltage is a function of the ratio of the gate characteristic of said second MOS transistor to the gate characteristic of said first MOS transistor.

9. The circuit recited in claim 8, wherein the widths of the gate electrodes of said first and second MOS transistors are equal so that the reference voltage is a function of the ratio of the gate length of said second MOS transistor to the gate length of said first MOS transistor.

10. The circuit recited in claim 9, wherein said gate electrodes of said first and second MOS transistors are interconnected, wherein said circuit further comprises a third MOS transistor for biasing said first and second MOS transistors so that the gate to source voltage of said first and second MOS transistors is equal.

11. The circuit recited in claim 8, wherein said first, second, and third currents are equal.

12. The circuit recited in claim 8, wherein said first and second MOS transistors are NMOS devices.

13. The circuit recited in claim 8, wherein said circuit is a BiCMOS circuit.

14. The circuit recited in claim 8, wherein said circuit is a CMOS circuit.

15. A bandgap circuit generating a bandgap reference voltage comprising:

a current mirror comprising first, second and third MOS transistors having interconnected gate electrodes;

a pair of bipolar transistors, a first one connected to said first MOS transistor and a second one connected to said second MOS transistor, wherein said pair of bipolar transistors have interconnected base electrodes;

a bipolar output transistor connected to said third MOS transistor and providing said reference voltage at a terminal thereof; and a pair of MOS transistors, a first one connected to said second bipolar transistor and a second one connected to said output transistor, wherein each of said MOS transistors is operated in the linear region in response to a bias voltage applied to a gate electrode thereof.

16. The circuit recited in claim 15 further comprising a second pair of MOS transistors, a first one having a gate electrode interconnected to the gate electrodes of said first, second and third MOS transistors of said current mirror, wherein an interconnection between said second pair of MOS transistors provides said bias voltage.

17. The circuit recited in claim 15 wherein said pair of MOS transistors are NMOS devices.

* * * * *

UNITED STATES PATENT AND TRADEMARK OFFICE

CERTIFICATE OF CORRECTION

PATENT NO. : 5,451,860

DATED : September 19, 1995

INVENTOR(S) : Joseph M. Khayat

It is certified that error appears in the above-indentified patent and that said Letters Patent is hereby corrected as shown below:

Column 1, line 61, "transistor Q8." should read --transistor Q8.--.

Column 5, line 45, in equation 7,

" $-\frac{1}{2} V^2_{DS}$" should read -- $-\frac{1}{2} V_{DS}^2$--.

Column 6, line 68, "$V_{bc}$" should read --$V_b$--.

Column 7, line 18, "transistors, More" should read --transistors. More--.

Signed and Sealed this

Twenty-third Day of April, 1996

Bruce Lehman

*Attest:*

BRUCE LEHMAN

*Attesting Officer*

*Commissioner of Patents and Trademarks*